US006550379B2

(12) United States Patent
Chiu

(10) Patent No.: US 6,550,379 B2
(45) Date of Patent: Apr. 22, 2003

(54) PRINTING MACHINE FOR PRINTING AN INTEGRAL DESIGN ON THE LEAVES OF A BLIND WITH ONE ROUND OF PROCESSING

(76) Inventor: Chin-Yung Chiu, No. 2, Alley 25, Lane 25, Guojung 1st Rd., Dali City, Taichung (TW), 412

( * ) Notice: Subject to any disclaimer, the term of this patent is extended or adjusted under 35 U.S.C. 154(b) by 65 days.

(21) Appl. No.: 09/945,844

(22) Filed: Sep. 5, 2001

(65) Prior Publication Data

US 2003/0041751 A1 Mar. 6, 2003

(51) Int. Cl.[7] ..... B41F 17/00
(52) U.S. Cl. ..... 101/37; 101/35
(58) Field of Search ..... 101/35, 36, 37, 101/373, 397, 399

(56) References Cited

U.S. PATENT DOCUMENTS 4,842,036 A * 6/1989 Goodman ..... 160/166.1
5,022,296 A * 6/1991 Eschauzier et al. ..... 83/27
5,169,699 A * 12/1992 Prince ..... 428/68
5,671,667 A * 9/1997 Simmet ..... 101/35
6,286,920 B1 * 9/2001 Ridgway ..... 347/2
6,378,421 B1 * 4/2002 Chiu ..... 101/35

* cited by examiner

*Primary Examiner*—Ren Yan
(74) *Attorney, Agent, or Firm*—Troxell Law Office PLLC

(57) ABSTRACT

A printing machine for printing an integral design on the leaves of a blind includes a material distributing device, a material delivering device, a printing device, a heat-drying device and a material tidying device combined together. Leaves preset in number are orderly separated and placed in the material distributing device to be pushed to the material delivering device and then each leaf is orderly pushed into the printing device for printing designs. After the leaves are printed with designs, they are heat-dried one by one orderly by the heat-drying device and subsequently carried to the material tidying device to be collected into units and tied up, thus possible to produce by a large number, to lower processing cost and greatly beautify the leaves of a blind.

5 Claims, 10 Drawing Sheets

PRINTING MACHINE FOR PRINTING AN INTEGRAL DESIGN ON THE LEAVES OF A BLIND WITH ONE ROUND OF PROCESSING

BACKGROUND OF THE INVENTION

This invention relates to a printing machine, particularly to one possible to print an integral design on the leaves of a blind with one round of processing.

At the present, a thermo-transfer printing method is commonly used for design processing. In accordance with a such method, designs expected to be printed are first made and processed on a thermo-transfer printing paper and then arrange the leaves of a blind in order and place them firmly on a mold specially used for thermo-transfer printing. Next, put the thermo-transfer printing paper on the leaves of a blind and finally compress the mold of a thermo-transfer printing machine on the thermo-transfer printing paper by applying an extremely high printing temperature ( between 200° C. and 250° C.) and high pressure to force the designs on the transfer printing paper transferred and printed on the surfaces of the leaves of a blind.

However, based on such a thermo-transfer printing method, the designs expected to be printed have to be transferred and printed on a thermo-transfer printing paper first to make transfer printing media and this thermo-transfer printing paper becomes a waste after used only once, impossible to be used again, thus increasing processing cost, resulting in environmental pollution and incapable to mass-production in a fast way. Besides, extremely high temperature is absolutely needed for transfer printing, so such a processing method is comparatively applicable to aluminum alloy, but not suitable for a material such as PVC or the like, which is unable to endure high temperature.

SUMMARY OF THE INVENTION

This invention has been devised to offer a printing machine for printing an integral design on the leaves of a blind with one round of processing, possible to stabilize processing quality and mass-production in a fast way.

The printing machine in this invention consists of a material distributing device, a material delivering device, a printing device, a heat-drying device and a material tidy device combined together. The material distributing device has a great many rail spaces arranged in parallel for leaves of the same number to pile therein. Each rail space is provided with a sucking disc for sucking and carrying a leaf to the material delivering device and then the leaf is pushed by a propping plate of the material delivering device to enter printing units of the printing device for printing designs. Then, after the leaves already printed with designs are respectively dried through the heat-drying device, they are carried to the material tidying device to be collected and tied up.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
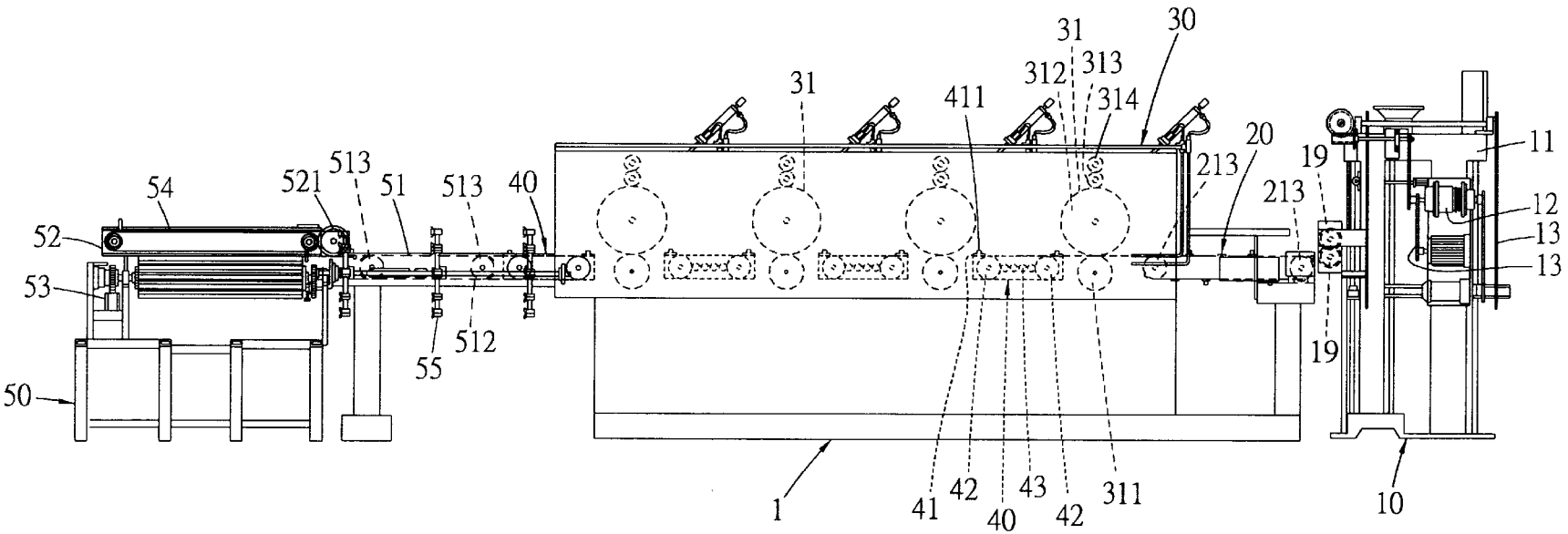
FIG. 1 is a side view of a printing machine for printing an integral design on the leaves of a blind in the present invention.

A preferred embodiment of a printing machine for printing an integral design on the leaves of a blind with one round of processing in the present invention, as shown in FIG. 1 includes a material distributing device 10, a material delivering device 20, a printing device 30, a plurality of heat-drying devices 40 and a material tidying device as main components combined together.

Figure 2:
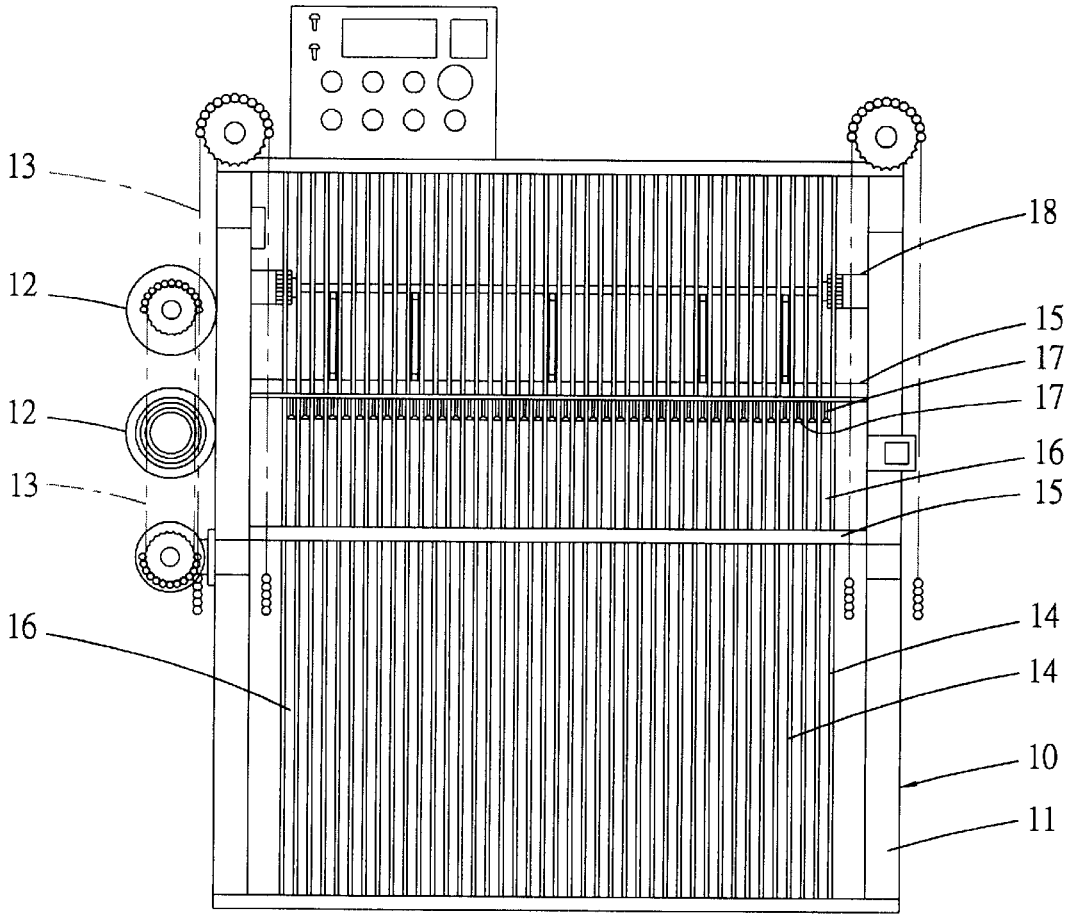
FIG. 2 is a cross-sectional view of a material distributing device in the present invention.

The material distributing device 10, as shown in FIG. 2, has an inverted-U shaped frame 11, a power device 12 and a transmitting chain 13 provided on one side for supplying power. Besides, a plurality of separating rods 14 are vertically arranged in parallel in two opposite spaces of the frame 11 and inserted spaced apart equidistantly through plural separating plates 15 provided horizontally on the frame 11 so as to stabilize and keep the separating rods 14 separated with a proper distance from one another, and forming a rail space 16 between every two separating rods 14. Then, a sucking disc 17 is provided exactly above each rail space 16 and all these sucking discs 17 are controlled by an air pressure source 18 in order to let them function synchronously. Further, a roller unit 19 is provided on the other side of the frame 11 for conveying the leaves.

Figure 3:
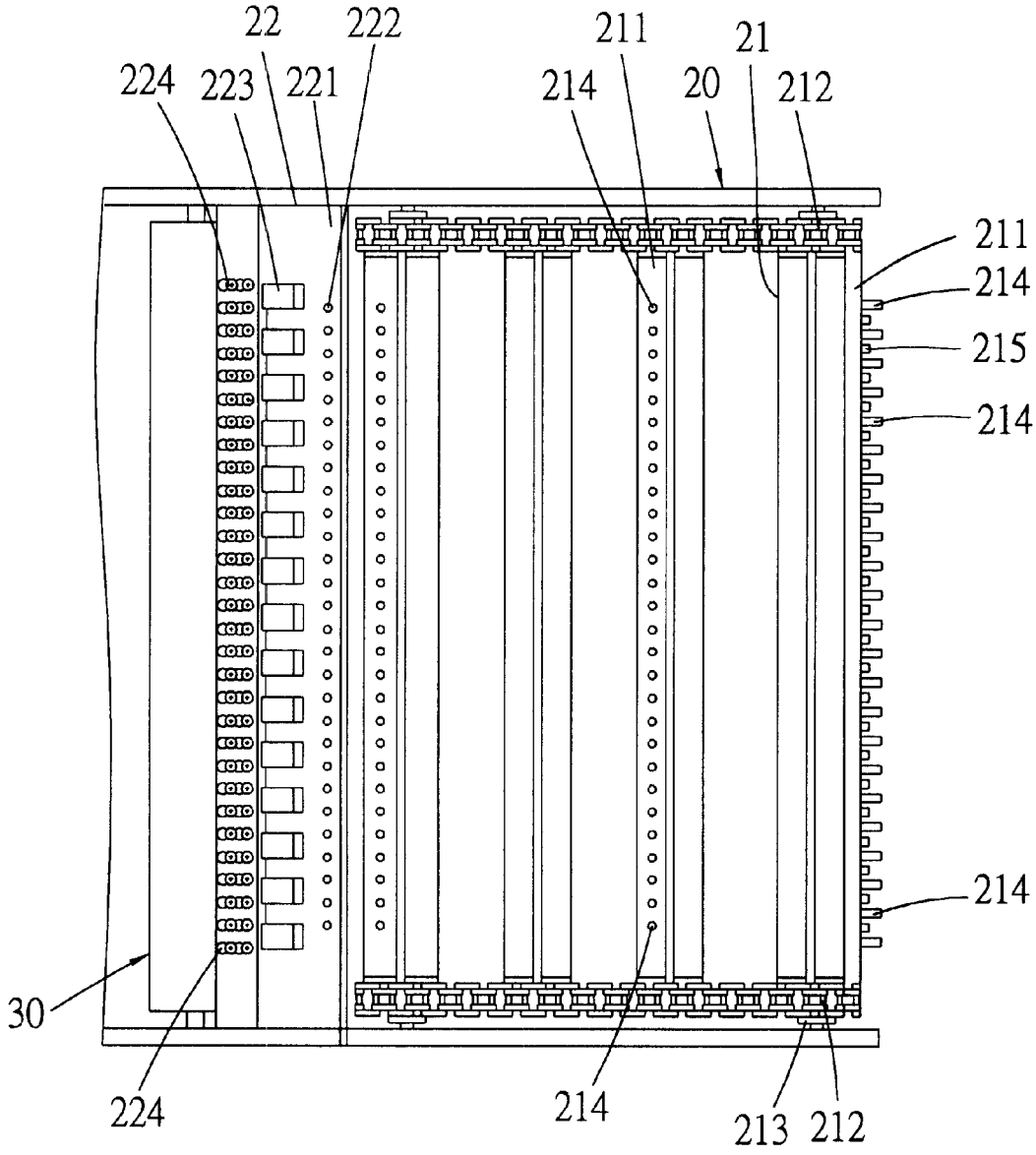
FIG. 3 is a top view of a material delivering device in the present invention.

The material delivering device 20, as shown in FIG. 3, is composed of a material propping device 21 and a wheel pressing device 22. The material propping device 21 is located beside the material distributing device 10, consisting of plural plates 211 preset in its quantity. The bottom surfaces of the two opposite sides of each plate 211 are pivotally connected to a chain 212 connected with a transmitting chain gear 213 moving the chain 212 to move the plates 211 forward. In addition, a plurality of projections 214 are provided spaced apart equidistantly on the top surface of each plate 211, forming a space between every two projections 214 to correspond to the rail space 16 of the material distributing device 10, and further a propping rod 215 is fixed between every two projections 214 of two equidistantly opposite plates 211. The wheel-pressing device 22 abuts on the material propping device 21, having a bottom plate 221. The bottom plate 221 has a plurality of projections 222 arranged spaced apart equidistantly on an inner side to conform to the projections 214 of the material propping device 21 and a plurality of separating members 223 provided spaced apart equidistantly on an outer side, with each separating member 223 positioned facing the space between every two projections 222. Besides, two rows of wheel pressing units 224 arranged in parallel are provided beside the separating members 223, with each wheel press unit 224 facing the space between every two separating members 223.

Figure 4:
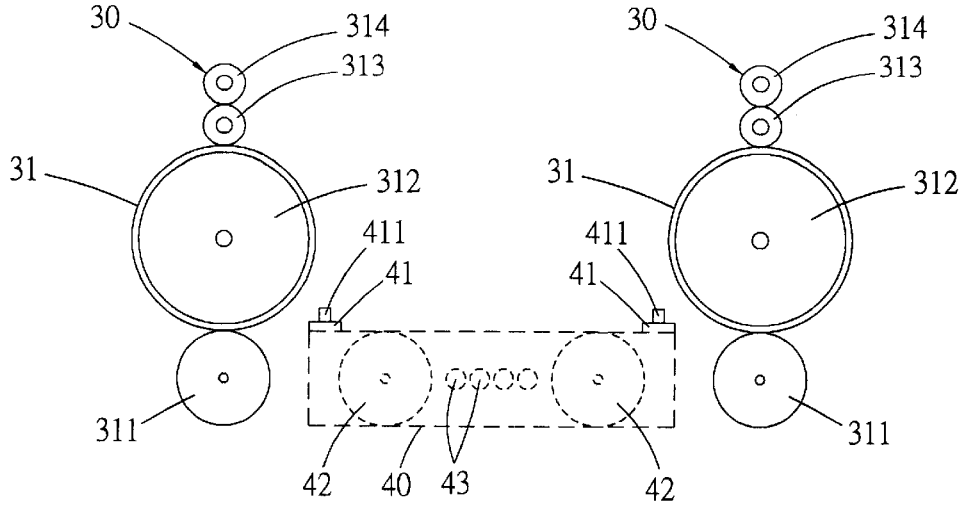
FIG. 4 is an exploded perspective view of a combination of a printing device and a drying device in the present invention.
Figure 5:
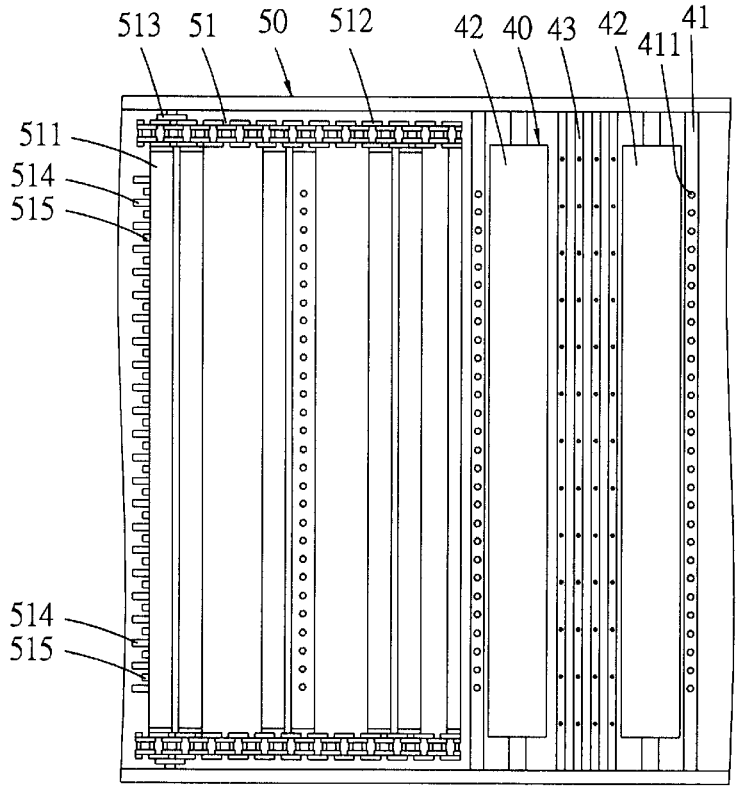
FIG. 5 is a top view of a combination of the drying device and the material tidying device in the present invention.

The printing device 30 abutting on the wheel press device 22, as shown in FIGS. 4 and 5, is composed of plural printing units 31. Each printing unit 31 has a PU plastic wheel 312 pivotally positioned on an upper portion and a support wheel 311 pivotally provided under the PU plastic wheel 312, with these two wheels contacting with each other. Then a printing plate wheel 313 having an ink wheel 314 on top is provided on the circumference of the PU plastic wheel 312. Additionally, the quantity of the printing units 31 to be provided is based on the kinds of printing colors required. For instance, in case four kinds of printing colors are needed, then four printing units are to be provided, and so forth. Only the printing units 31 have to be arranged adjacent to each other.

The heat-drying devices 40 are respectively provided at a lower portion between every two printing units 31 and the heat-drying devices 40 are equal to the printing units 31 in its quantity. Each heat-drying device 40 is provided with a guide plate 41 on an upper side and a guide wheel 42 provided in two opposite inner sides. Each guide plate 41 has a plurality of projections 411 arranged spaced apart equidistantly on top, forming a space between two projections 411 to receive and guide a leaf 60 therein. Further, plural ultra-violet lamps 43 are provided at a lower portion between two guide wheels 42 for drying the ink printed on the leaves at a high speed because ultra violet ink is used in this invention.

Figure 6:
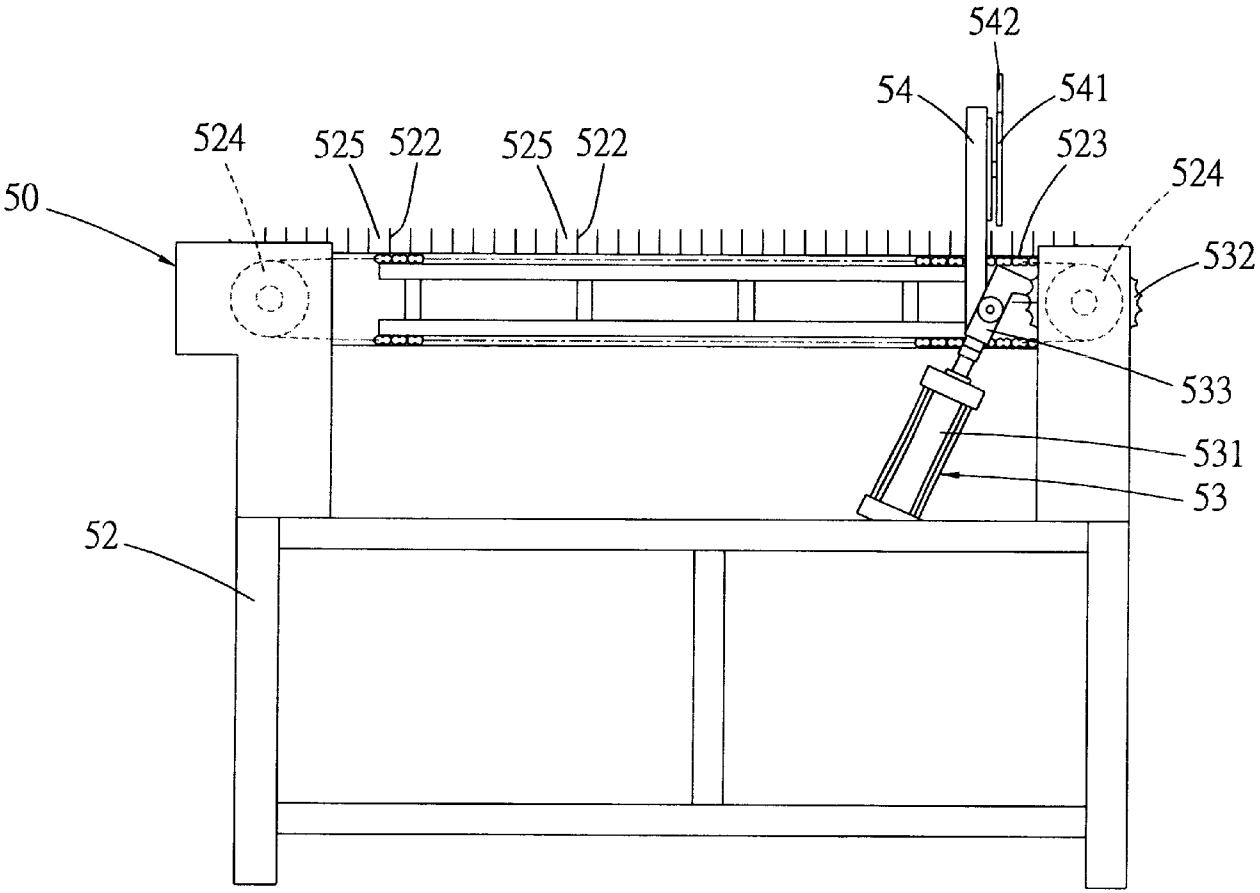
FIG. 6 is a partial cross-sectional view of the material tidying device in the present invention.

The material tidying device 50 consists of a material pushing device 51, a material collecting device 52, a micro-driving device 53, a propping and pushing device 54 and a tying device 55. The material pushing device 51, as shown in FIGS. 5 and 6, is positioned beside the heat-drying device 40, nearly having the same structure and the same way of operation as those of the material propping device 21 of the material delivering device 20, that is, having a plate 511, a chain 512 and a transmitting chain gear 513, with a plurality of projections 514 for guiding the leaves 60 and further a propping rod 515 positioned between two projections 514.

Then, two rear rollers 521 rotating oppositely are provided between the collecting device 52 and the material push device 51, having many separating plates 522 and a chain 523 on one side. The chain 523 is engaged with two transmitting gears 524 positioned oppositely and a collecting space 525 is formed between every two separating plates 522.

The micro-driving device 53 is composed of a pressure cylinder 531 and a ratchet 532. The ratchet 512 is fixed on the same shaft of the transmitting gear 524, and the pressure cylinder 531 is fitted with a piston rod 533 extending out, with the piston rod 533 engaging with the ratchet 532. Thus, when the ratchet 532 is driven by the pressure cylinder 531 to move for a tooth distance, the collecting spaces 525 of the collecting device 52 are activated to move forward a space.

Figure 7:
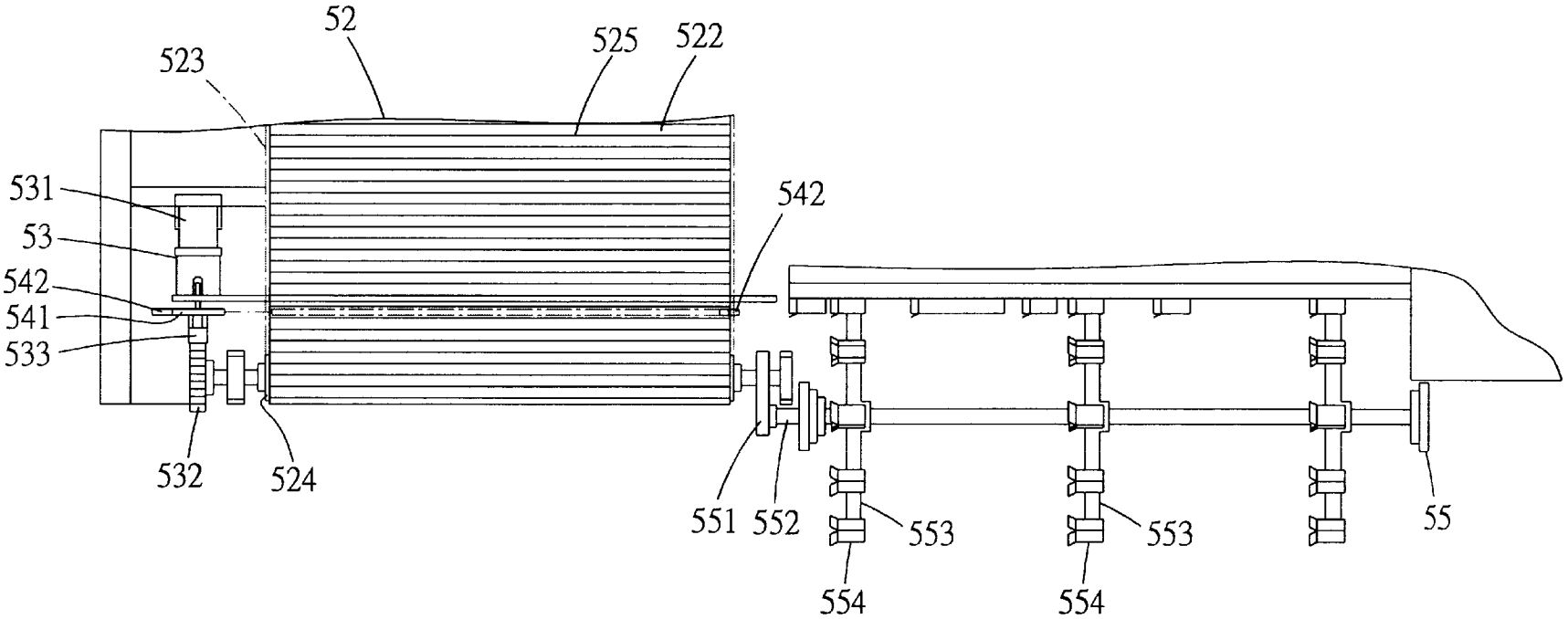
FIG. 7 is a top view of the material tidying device in the present invention.

The propping and pushing device 54 is adjacent to the micro-driving device 53, as shown in FIG. 7, having a chain 541 aligned with the direction of the collecting space 525. The chain 541 has a pushing plate 542 extending out from the opposite side to be activated by the 541 to move into the collecting space 525 to push the leaf 60.

The tying device 55 and the collecting device 52 are operated to move synchronously by means of a chain 551 connected to a rotating shaft 552 between them. The rotating shaft 552 has plural disks 553 fitted around and spaced apart equidistantly and each disk 553 has plural support members 554 fixed spaced apart equidistantly on its circumference, with the support members 554 of one disk 553 respectively aligned with those of another disk 553, and also corresponding to the collecting spaces 525 of the collecting device 52.

Next, the processes of printing an integral design on the leaves of a blind in this invention are described below.

Figure 8:
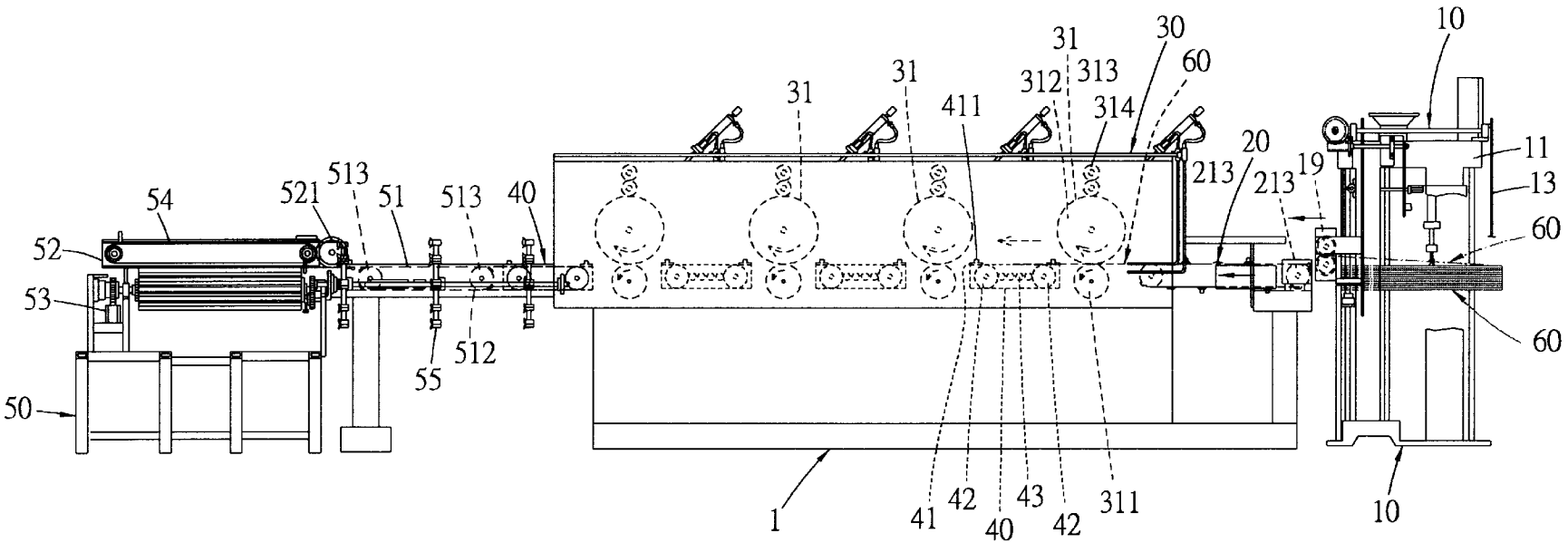
FIG. 8 is a side cross-sectional view of the processes of printing an integral design on the leaves of a blind in the present invention.
Figure 9:
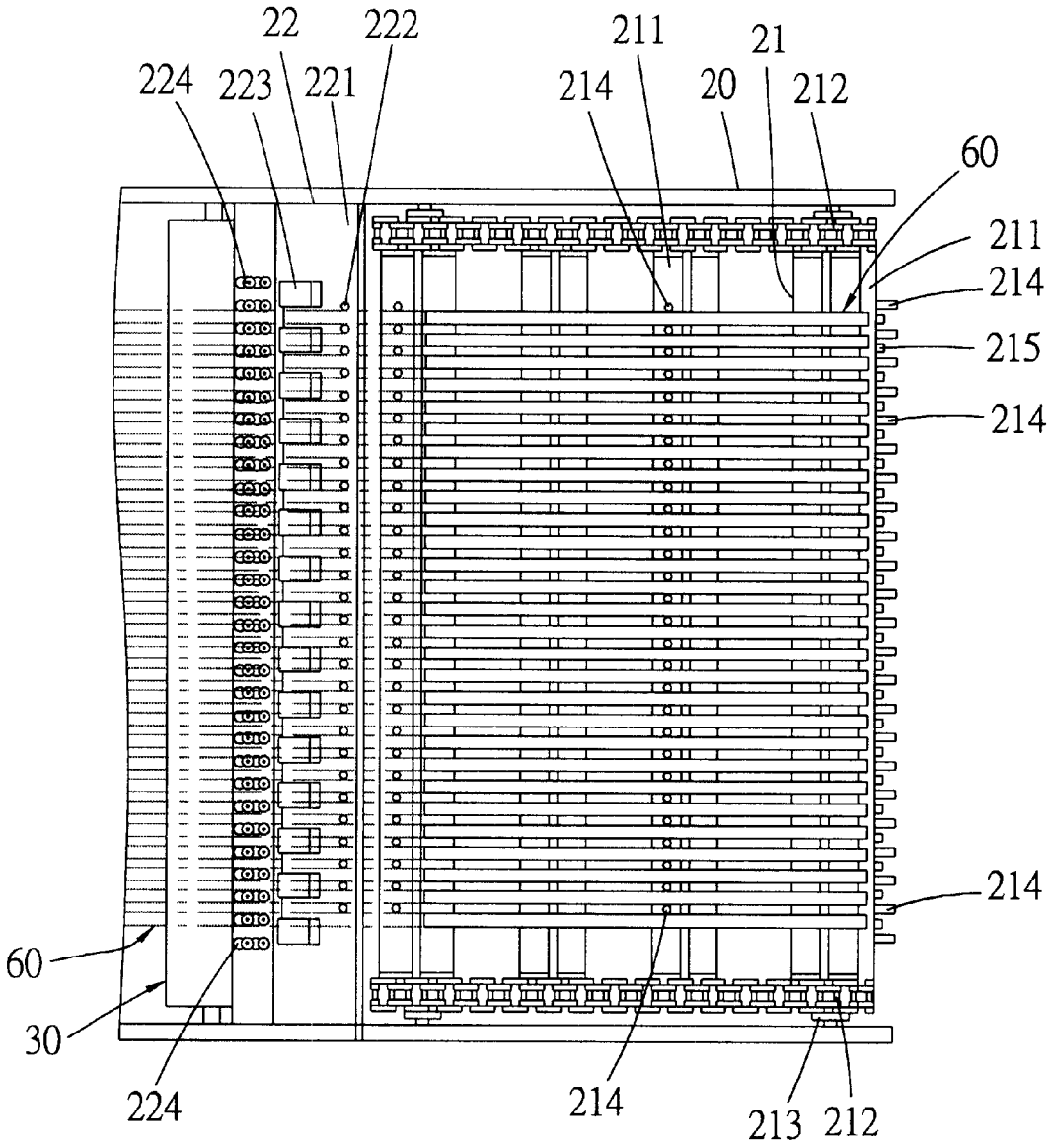
FIG. 9 is a top view of the material delivering device in an operating condition in the present invention.

Referring to FIGS. 8 and 9, firstly an equal number of leaves 60 is placed in each rail space 16 of the material distributing device 10. Then, the sucking disks 17 of the material distributing device 10 are operated to suck an uppermost leaf 60 in each rail space 16 and carry it to the roller unit 19 to be pressed in the material propping device 21 of the material delivering device 20, with each leaf 60 positioned between two projections 214. After separating from the roller unit 19, the leaf 60 continues to be pushed forward by the material propping device 21, passes through the bottom plate 221 of the wheel pressing device 22 and then moves in the space between two separating members 223 via the space between two projections 222. Thus, two abutting leaves 60 in a vertical condition are pushed in between two pressing wheels 224. And then the leaf 60 is forced by the two pressing wheels 224 to move into the printing device 30, and at this time each leaf 60 after pressed by the pressing wheels 224 becomes slightly curved up.

After the leaf 60 is pushed by the propping rod 215 to move into a first printing unit 31 of the printing device 30, it is sandwiched by the support wheel 311 and the PU plastic wheel 312 of the printing unit 31 and then driven to move forward by rotating of these wheels 311 and 312 to pass through the first printing unit 31. Meanwhile, the surface of this leaf 60 is printed on with the same design on the printing plate wheel 313 and the portion of the leaf just printed with design passes the first printing unit 31 and is dried at the same time by the heat-drying device 40. And then this leaf keeps on moving forward and enters a second printing unit 31 for a second-time printing with a design of different color and so forth . Thus, the leaves of a blind are printed on with an integral design bright and beautiful.

Figure 10:
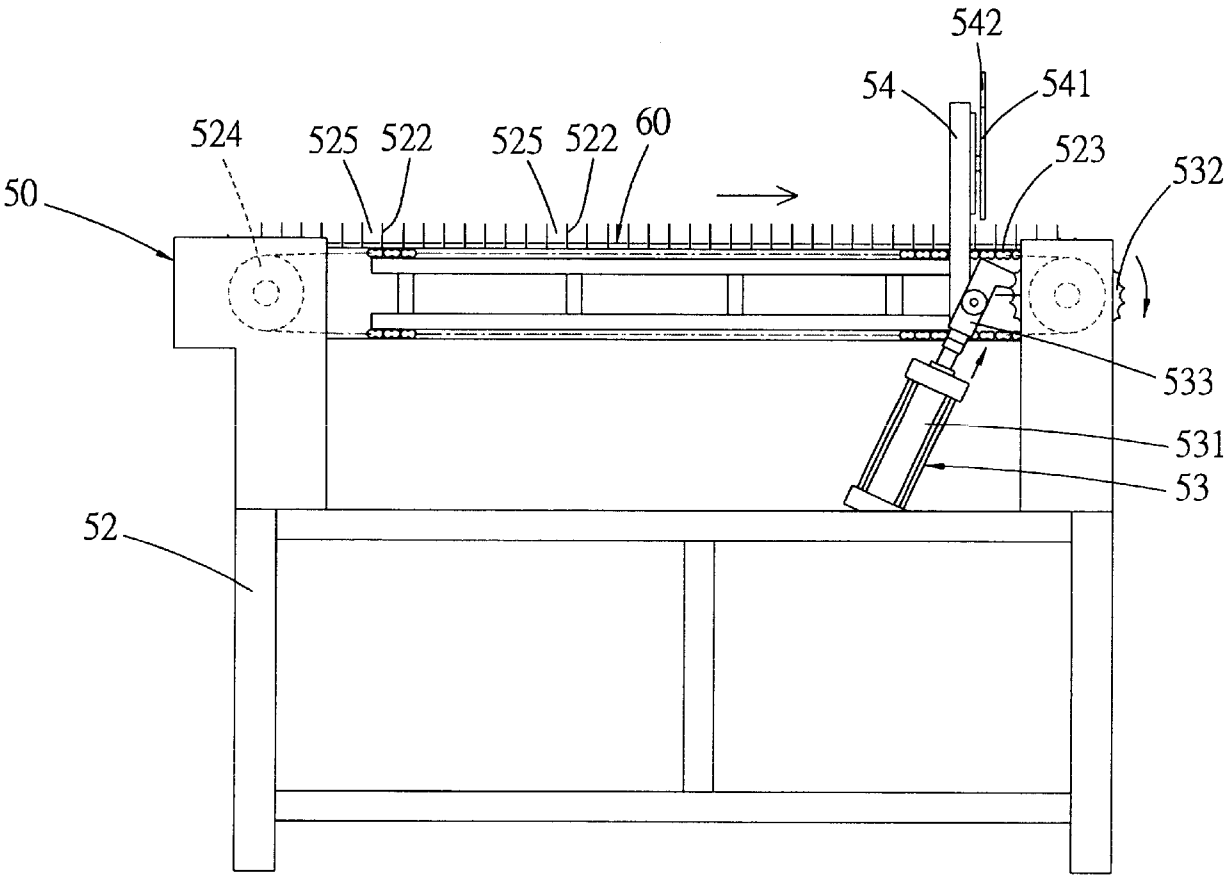
FIG. 10 is a cross-sectional view of the material collecting device in the present invention: and, FIG. 11 is a cross-sectional view of the material collecting device, the material propping device and the material tidying device in cooperation in the present invention.
Figure 11:
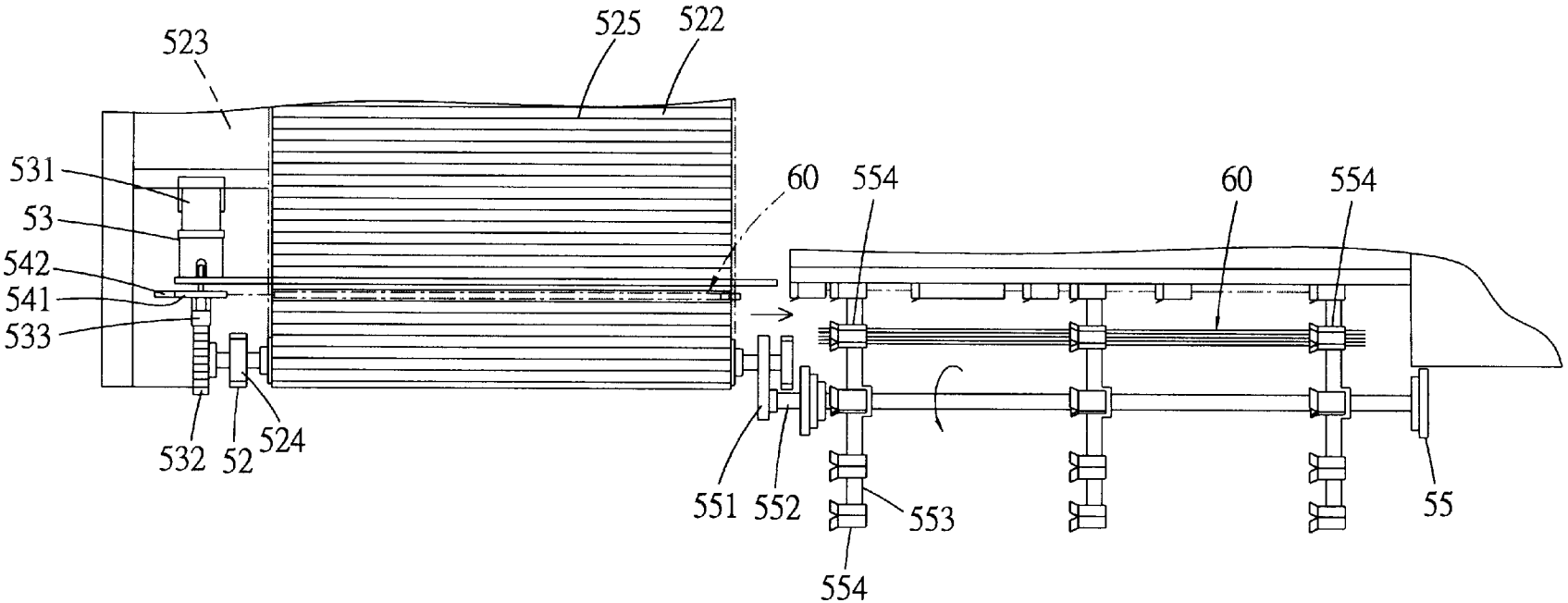

Next, referring to FIGS. 10 and 11, after the leaf 60 is printed on with a design and heat-dried, it is pushed to move into the space between two projections 514 of the material pushing device 51 of the material tidying device 50 and then pushed into the collecting space 525 of the collecting device 52. As the leaf 60 collected in each collecting space 525 is only a part of the integral design of a blind, therefore, after each collecting space 525 receives a leaf, the pressure cylinder 531 of the micro-driving device 53 drives the ratchet 532 to move a tooth distance and synchronously the collecting space 525 is activated to move horizontally for a space for receiving a next leaf 60. Thus, each collecting device 52 can collect a unit of leaves 60 of an integral design after rotating for a complete round.

After the leaves 60 are collected into units, the collecting space 525 rotates exactly to a lower side of the propping and pushing device 54, as shown in FIG. 11. At this time, the actuating chain 541 of the propping and pushing device 54 activates its pushing plate 542 to push the unit of leaves to move in between the support members 554 of the disks 553 of the tying device 55. Finally each unit of leaves 60 is tied up into a bunch, thus obtaining a unit of leaves with an integral design In short, this invention has the following advantages as can be noted from the above description.

1. The designs are directly printed on the leaves with colorful ink, so the designs printed are bright and beautiful and also easy to be washed.

2. The designs are duplicated in shape on printing plates for printing on the leaves, so the speed of printing process is much faster than of a conventional thermo-transfer printing method, and the quality and quantity of products of this invention can hardly be acquired by any conventional method, evidently enhancing quality of products and lowering processing cost.

3. The printing plates used for printing designs on the leaves of a blind with ink can be used repeatedly, without a problem of environmental pollution caused by the thermo-transfer printing paper used in a conventional printing process.

4. The process of printing an integral design on the leaves of a blind by the printing machine of the present invention is completely automatic, elevating capacity of producing and stabilizing quality controlling.

While the preferred embodiment of the invention has been described above, it will be recognized and understood that various modifications may be made therein and the appended claims are intended to cover all such claims that may fall within the spirit and scope of the invention.

I claim:

1. A printing machine for printing an integral design on the leaves of a blind comprising:

A material distributing device having an inverted-U shaped frame provided with a plurality of vertical separating rods spaced apart equidistantly, a rail space formed between every two said separating rods for receiving said leaves, each said rail space having a sucking disk on top for sucking said leaves and carrying them forward, said frame also having roller units provided on one side for driving said leaves to move forward;

A material delivering device consisting of a material propping device and a wheel pressing device, said material propping device composed of a plurality of plates preset in its quantity and connected by a chain, said plates positioned in parallel to said rollers of said material distributing device and having many projections fixed space apart equidistantly on top, a preset space formed between every two of said projections, and said space corresponding to said rail space of said material distributing device, further a propping rod provided in said space of every two said projections of one of said plates, said wheel pressing device having its separating members abutting said material propping device and each said separating member facing said space of said projections, thus abutting two of said leaves moving through said separating members in a vertical condition and then pushed in the pressing wheels of said wheel pressing device, letting the top surface of each said leaf slightly curved up by the pressing of said pressing wheel;

A printing device abutting said material delivering device and composed of several printing units preset in its quantity, each said printing unit containing a support wheel and a PU plastic wheel, each said PU plastic wheel having a printing plate wheel provided at a preset position on top of each PU plastic wheel and said printing plate wheel also having an ink wheel thereon so that the color and design attached on said PU plastic wheel can be printed directly on said leaves;

A plurality of heat-drying devices preset in its quantity respectively provided behind each said printing unit, said leaf printed with design pushed out of said printing units and carried to said heat-drying devices by a second material propping device, thus the design and color printed on said leaf heat-dried in shape therein;

A material tidying device provided with a roller unit to carry said leaf heat-dried to a collecting device, said collecting device having a plurality of separating plates arranged spaced apart equidistantly and connected by a chain, said collecting device having a plurality of collecting spaces formed between every two of said separating plates for collecting said leaves, then a micro-driving device composed of a pressure cylinder and a ratchet and matching with said leaves printed, said ratchet driven to move a tooth distance, said collecting device operated to move a space forward, thus each said collecting space orderly facing separately said leaves one by one, said collecting spaces moving a complete round, each said collecting space collecting a complete unit of said leaves, then each unit of said leaves pushed to said tidying device by said propping and pushing device and tied up stably therein.

2. The printing machine for printing an integral design on the leaves of a blind as claimed in claim 1, wherein solvent ink is used for printing, so said leaves with designs are dried up by hot wind.

3. The printing machine for printing an integral design on the leaves of a blind as claimed in claim 1, wherein UV (ULTRA VIOLET) ink is used for printing, so a ultra-violet ray is needed for heat drying.

4. The printing machine for printing an integral design on the leaves of a blind as claimed in claim 1, wherein four of said printing units are provided.

5. Said printing machine for printing an integral design on the leaves of a blind as claimed in claim 1, wherein five of said printing units are provided.

* * * * *